United States Patent [19]

Fujita

[11] 4,266,563

[45] May 12, 1981

[54] COIN DISPENSER DEVICE

[75] Inventor: Niitaka Fujita, Neyagawa, Japan

[73] Assignee: Matsushita Electric Industrial Co., Ltd, Osaka, Japan

[21] Appl. No.: 128,115

[22] Filed: Mar. 7, 1980

[30] Foreign Application Priority Data

Mar. 9, 1979 [JP] Japan ..... 54-28091

[51] Int. Cl.[3] ..... G07D 9/04

[52] U.S. Cl. ..... 133/4 A

[58] Field of Search ..... 133/4 R, 4 A, 5 R, 8 B; 221/129, 114, 112, 126

[56] References Cited

U.S. PATENT DOCUMENTS 2,204,853 6/1940 Goodman ..... 133/5 R X

*Primary Examiner*—Stanley H. Tollberg

*Attorney, Agent, or Firm*—Spencer & Kaye

[57] ABSTRACT

A coin dispenser device of a simple construction for automatic vending machines and automatic money-changing machines, comprising a combination of slide plates for dispensing coins from coin storing cylinders, and changeover plates each of which is arranged to slidingly move a different pair of slide plates in the lateral direction to come into engagement with one of a pair of slide plates. Owing to the combination of these parts, the coin dispenser device can be accurately operated even when the number of the coin storing cylinders is increased.

2 Claims, 4 Drawing Figures

COIN DISPENSER DEVICE

BACKGROUND OF THE INVENTION

1. Field of the Invention

The present invention relates to a coin dispenser device for automatic vending machines and automatic moneychanging machines and, more particularly, to a coin dispenser device of a simple construction which has a plurality of parallel coin-storing cylinders and which permits being operated accurately.

2. Description of the Prior Art

In a conventional coin dispenser device using driving solenoids, it is necessary to provide solenoids in such a number as that of the coin storing cylinders in use. A conventional coin dispenser device using a drive motor has a complicated construction and cannot be manufactured at a low cost.

SUMMARY OF THE INVENTION

An object of the present invention is to eliminate the above-mentioned drawbacks encountered in conventional coin dispenser devices.

To this end, the present invention provides a coin dispenser device comprising a plurality of coin storing cylinders, a plurality of slide plates disposed in opposition to the coin storing cylinders and slidingly movable in the longitudinal direction so as to dispense the coins from the cylinders, change-over plates each of which is disposed in opposition to different pairs of the slide plates and each of which is movable in the lateral direction to come into engagement with one of each pair of the slide plates, and driving solenoids for slidingly moving the change-over plates in the longitudinal direction, and characterized in that the slide plates are moved independently by a combination of the lateral movements of the change-over plates for allowing the change-over plates to come into engagement with one of that pair of the slide plates which are opposed thereto, and the longitudinal movements of the change-over plates caused by the driving solenoids, to thereby dispense desired coins.

The above object as well as advantageous features of the invention will become clear from the following description of the preferred embodiment taken in conjunction with the accompanying drawings.

DESCRIPTION OF THE PREFERRED EMBODIMENT

Figure 1:
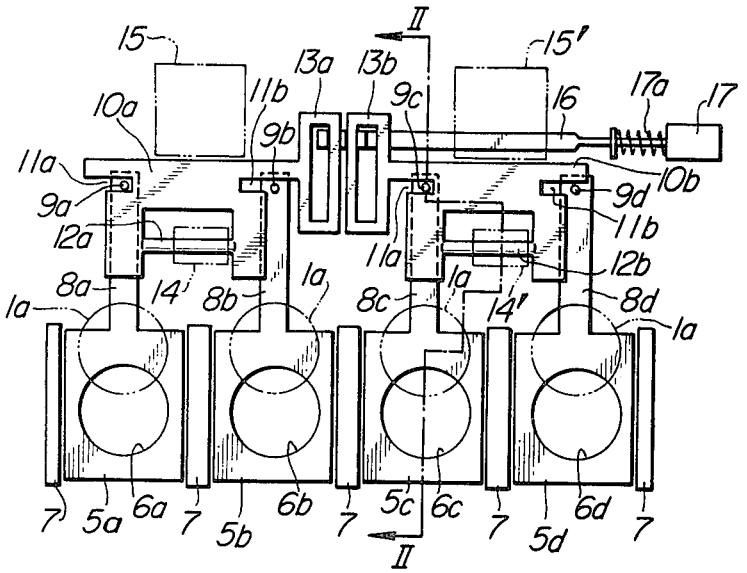
FIG. 1 is a plan view of a principal portion of a coin dispenser device embodying the present invention.
Figure 2:
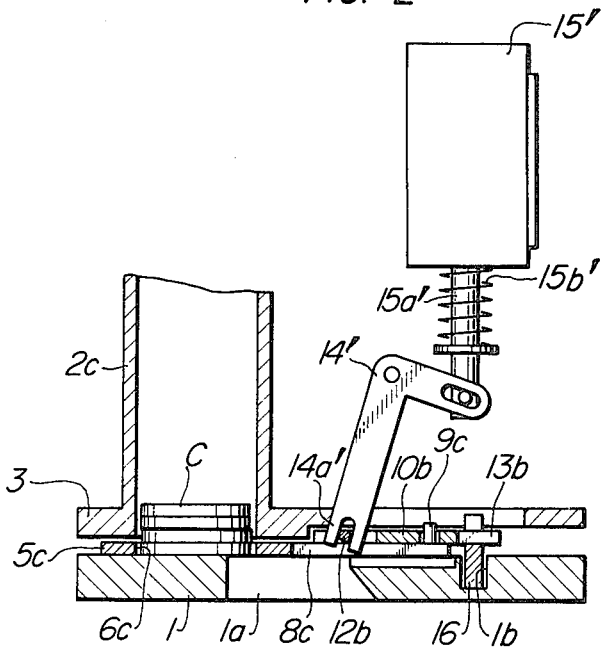
FIG. 2 is a sectional view taken along the line II—II in FIG. 1.
Figure 3:
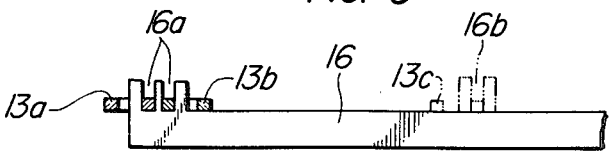
FIG. 3 is a front elevational view partially in cross section of a change-over lever used in the embodiment shown in FIG. 1.

A coin dispenser device embodying the present invention having, for example, four coin storing cylinders will be described with reference to FIGS. 1-4.

Referring to the drawings, reference numeral 1 denotes a bottom plate on which a top plate 3 having four coin storing cylinders 2*a*–2*d* (2*a*, 2*b*, 2*d* are not shown) is provided such that the top plate 3 is spaced from the bottom plate 1 by a distance greater than the thickness of a coin.

The bottom plate 1 is provided at its intermediate portion with dispensation ports 1*a* from which coins 4 dispensed from the coin storing cylinders 2*a*–2*d* are discharged.

Reference numerals 5*a*–5*d* denote flat slide plates disposed in opposition to the coin storing cylinders 2*a*–2*d*. The slide plates 5*a*–5*d* are provided in their respective central portions with circular openings 6*a*–6*d* the diameter of which is equal to the inner diameter of the coin storing cylinders 2*a*–2*d*, and can be slidingly moved in the longitudinal direction alone in a space between the bottom plate 1 and the top plate 3. Each of the slide plates 5*a*–5*d* is isolated or guided by partition walls 7 such that the openings of the coin storing cylinders 2*a*–2*d* and the openings 6*a*–6*d* in the slide plates 5*a*–5*d* are in alignment with one another when a coin dispensing operation is not conducted.

The slide plates 5*a*–5*d* have integrally formed control members 8*a*–8*d* projected therefrom, and upwardly projected pins 9*a*–9*d* are provided on the upper surfaces of the front end portions of the control members 8*a*–8*d*.

Reference numeral 10*a*, 10*b* denote change-over plates disposed such that they can be slidingly moved in both longitudinal and lateral directions between the control members 8*a*–8*d* of the slide plates 5*a*–5*d*. Each of the change-over plates 10*a*, 10*b* is provided with recesses 11*a*, 11*b* arranged to allow the pins 9*a*–9*d* on the slide plates 5*a*–5*d* to come into engagement therewith.

The number of the change-over plates 10*a*, 10*b* is a half as large as that of the slide plates 5*a*–5*d*.

The change-over plate 10*a*, which extends from the control member 8*a* of the slide plate 5*a* to the control member 8*b* of the slide plate 5*b*, is provided with a motion receiving arm 12*a* in that portion thereof which is between the control members 8*a*, 8*b*, while the change-over plate 10*b*, which extends from the control member 8*c* of the slide plate 5*c* to the control member 8*d* of the slide plate 5*d*, is provide with a motion receiving arm 12 in that portion thereof which is between the control members 8*c*, 8*d*. The change-over plates 10*a*, 10*b* are also provided with frame type change-over sliding members 13*a*, 13*b*, which are integrally formed therewith, respectively, at those end portions thereof which are adjacent to each other.

Reference numerals 14, 14' denote L-shaped crank levers having bifurcated portions 14*a* (not shown), 14*a'* at one end portion of each thereof, with which the motion receiving arms 12*a*, 12*b* of the change-over plates 10*a*, 10*b* are engaged. These crank levers 14, 14' are connected at the other end portions thereof to drive shafts 15*a* (not shown), 15*a'* of driving solenoids 15, 15'. The drive shafts 15*a*, 15*a'* of the solenoids 15, 15' are constantly urged by springs 15*b* (not shown), 15*b'* in the direction in which the drive shafts 15*a*, 15' are extended from the solenoids 15, 15'.

Reference numeral 16 denotes a change-over lever having at one end portion thereof recesses 16*a* arranged to allow the change-over sliding members 13*a*, 13*b* of the change-over plates 10*a*, 10*b* to be engaged therewith. The change-over lever 16 is disposed in a groove 1*b* provided in the bottom plate 1, such that lever 16 can be slidingly moved in the lateral direction while being guided by the groove 1*b*.

Reference numeral 17 denotes a change-over solenoid, and the change-over lever 16 is connected at the other end portion thereof to a drive shaft of the solenoid 17, which drive shaft is constantly urged by a spring in a direction in which the drive shaft is extended from the solenoid 17.

As is clear from the above-described construction of a coin dispenser device according to the present invention, one of the slide plates 5a–5d is rearwardly slided when the driving solenoids 15, 15' are turned on, and it is returned to the original position by the forces of springs 15b, 15b' when the driving solenoids are turned off.

Figure 4:
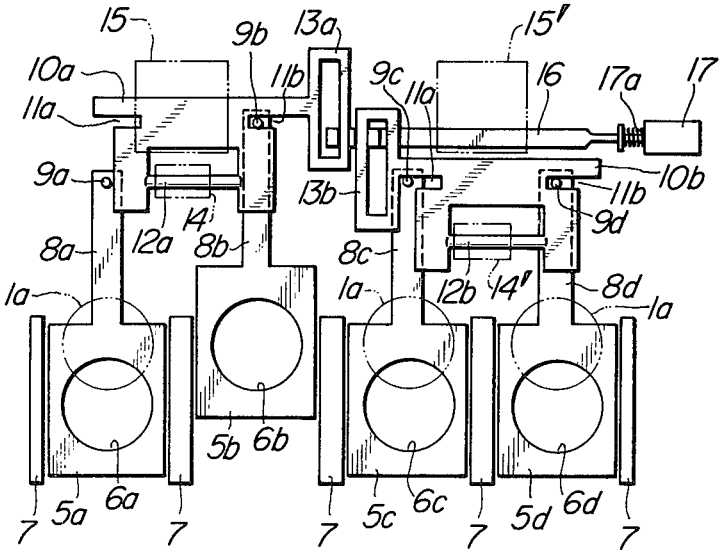
FIG. 4 is a plan view illustrating a coin dispensing action of the embodiment shown in FIG. 1.

When the change-over solenoid 17 is turned on, the change-over lever 16 is slidingly moved to the right in FIG. 1 so that the recesses 11a, 11b in the change-over plates 10a, 10b come into engagement with the pins 9a–9d on the slide plates 5a–5d as shown in FIG. 4, and, when the change-over solenoid 17 is turned off, the change-over lever 16 is returned to the original position by the force of the spring 17a.

The bifurcated portions 14a, 14a' of the crank levers 14, 14' are fixedly positioned such that the bifurcated portions 14a, 14a' are not laterally moved with the corresponding driving solenoids 15, 15'. The bifurcated portions 14a, 14a' have a suitable width so that they can serve as guides for the motion receiving 12a, 12b of the change-over plates 10a, 10b when the change-over plates 10a, 10b are laterally moved.

The change-over plates 10a, 10b and slide plates 5a–5d are arranged with respect to their positions such that, when the change-over lever 16 are urged to a left side position, the recesses 11a in the change-over plates 10a, 10b are in engagement with the pins 9a, 9c on the slide plates 5a, 5c, with the recesses 11b not in engagement with the pins 9b, 9d on the slide plates 5b, 5d, and such that, when the change-over solenoid 17 is turned on to allow the change-over lever 16 to be moved to a right side position, the recesses 11a in the change-over plates 10a, 10b are disengaged from the pins 9a, 9c on the slide plates 5a, 5c, with the recesses 11b coming into engagement with the pins 9b, 9d on the slide plates 5b, 5d.

The slide plates 5a–5d in the above-described embodiment are disposed above the change-over plates 10a, 10b but the positions of these parts may be reversed.

The operation of a coin dispenser device according to the present invention the construction of which is as described above will now be explained.

For example, an automatic vending machine may require four coin storing cylinders containing different kinds of coins A, B, C, D, respectively, for the dispensation of change, or four coin storing cylinders consisting of two cylinders containing coins B and another two cylinders containing coins C for meeting a great demand of change in these coins. In these cases, it is necessary that a necessary number of coins be dispensed separately from each of the coin storing cylinders.

Assuming that four coin storing cylinders contain coins A, B, C, D (only C is shown), respectively, which are to be dispensed by slide plates 5a, 5b, 5c, 5d, respectively. In order to actuate this coin dispenser device, which is in a standing-by state with the slide plates 5a–5d, the change-over plates 10a, 10b and the change-over lever 16 in a positional relationship as shown in FIG. 1, for the dispensation of the coins A, a driving solenoid 15 alone is energized by means of a dispensation signal so that a bifurcated portion 14a of a crank lever 14 is lowered in the rearward direction. Consequently, the change-over plate 10a, the change-over sliding member 13a of which is guided by recesses 16a in the change-over lever 16, is lowered straightly in the rearward direction without being twisted. At the same time, the slide plate 5a, the pin 9a to which is engaged with a recess 11a in the change-over plate 10a, is slidingly moved in the rearward direction to cause a coin A to be dropped from a dispensation port 1a.

When the driving solenoid 15 is deenergized, the slide plate 5a is returned to the original position by the force of a spring 15b and a subsequent coin A is then stored in an opening 6a, at which moment one dispensation operation is completed.

In this coin dispensation operation, a necessary number of coins can be dispensed by applying an electric current to the driving solenoid 15 intermittently in such number of times that is in accordance with the number of coins to be dispensed.

In the above-described case, the pin 9b on the slide plate 5b for use in dispensing the coins B is disengaged from the recess 11b and, therefore, the slide plate 5b is never moved even when the change-over plate 10a is slidingly moved in the longitudinal direction. In addition, no electric current is applied in this case to the other driving solenoid 15' and the change-over solenoid 17 so that the coins A relating to the slide plate 5a only can be dispensed.

In order to dispense coins B, the change-over solenoid 17 is energized by means of a dispensation signal and an electric current is then applied to the driving solenoid 15 when 100–500 msec have elapsed after the energization of the solenoid 17. The positional relationship among the parts of the coin dispensation device in the above-mentioned stage of operation is shown in FIG. 4. In this case, an electric current is applied to the change-over solenoid 17 to move the change-over lever 16 to right. As a result, the change-over plates 10a, 10b are moved parallel to each other to right without being twisted as the change-over plates 10a, 10b are guided by the bifurcated portion 14a of the crank lever 14. An electric current is then applied to the driving solenoid 15 so that, since the recess 11b in the change-over plate 10a has been moved to a right side position, and come into engagement with the pin 9b on the slide plate 5b with the pin 9a on the slide plate 5a being disengaged from the recess 11a at the same time, the slide plate 5b only is caught by the change-over plate 10a, which is then slidingly moved in the rearward direction with the slide plate 5a being left in the original position, so as to allow a coin B to be dropped from the dispensation port 1a. When the driving solenoid 15 is then deenergized, the slide 5b is returned to the original position and a subsequent coin is stored in the opening 6b upon the completion of one coin dispensation operation.

This coin dispensation operation can be repeated in the same manner as mentioned above by applying an electric current to the driving solenoid 15 intermittently in such number of times that is in accordance with the number of coins to be dispensed. The change-over solenoid 17 continues to be energized throughout a period of time during which a change dispensation operation by the driving solenoid 15 is conducted.

After the change dispensation operation has been completed, the driving solenoid 15 is deenergized. As a result, the change-over lever 16 is returned to a position shown in FIG. 1 by the force of the spring 17a, to allow the change-over plates 10a, 10b to the original positions.

As may be understood from the above description, the slide plate 5*c*, the change-over plate 10*b*, the crank lever 14' and the driving solenoid 15' work for the dispensation of coins C in the same manner as the slide plate 5*a*, the change-over plate 10*a*, the crank lever 14 and the driving solenoid 15. Namely, a desired number of the coins C can be dispensed by applying an electric current intermittently to the driving solenoid 15'.

In the dispensation of the coins D, the slide plate 5*d*, the change-over plate 10*b*, the crank lever 14' and the driving solenoid 15' are operated in the same manner as the slide plate 5*b*, the change-over plate 10*a*, the crank lever 14 and the driving solenoid 15 which are operated for the dispensation of the coins B. Namely, the dispensation of coins D can be effected by initially energizing the change-over solenoid 17 and thereafter applying an electric current to the driving solenoid 15' intermittently when 100–500 msec have elapsed after the energization of the change-over solenoid 17. After coins D have been dispensed, the driving solenoid 15' is deenergized to complete the dispensation operation.

A coin dispenser device according to the present invention permits dispensing coins accurately and quickly owing to the actions described above of each part thereof.

The above-described embodiment has four coin storing cylinders. When it is necessary that two coin storing cylinders be added or that a total of six coin storing cylinders be used, a recess 16*b* is formed in the change-over lever 16 as shown in broken line in FIG. 3, and a change-over sliding member 13*c* of an additionally provided change-over plate is fitted in the recess 16*b* so that additionally provided slide plates are thereby driven.

Even when such a large number of coin storing cylinders as mentioned above are used, a coin dispensation operation can be carried out by only one change-over lever 16. The displacement of this change-over lever 16 can be achieved by one small-sized change-over solenoid 17 of a small amperage.

When an odd number of coin storing cylinders, for example, five coin storing cylinders, are used, the four cylinders out of five are constructed in pairs in the same manner as the above-described embodiment having four coin storing cylinders, and the remaining one cylinder is constructed such that it can be subjected to operation by driving the relative slide plate directly by the crank lever without using a change-over plate.

A coin dispenser device according to the present invention as described above has the following effect.

In general, a conventional coin dispenser device is provided with such a number of driving solenoids that is in agreement with the number of coin storing cylinders in use. The capacity of a driving solenoid in use is influenced by the number of coins to be contained in the corresponding coin storing cylinder. A solenoid of not less than 100 VA is required in an ordinary case, which is large in size and weight and which is not economical when more than one coin storing cylinder is used.

Further, a conventional coin dispenser device using one drive motor to dispense coins from 2–4 coin storing cylinders is small in weight but it is complicated in construction, broken down frequently and high in manufacturing cost.

On the other hand, a coin dispenser device according to the present invention can be operated with n pieces of driving solenoids when 2n pieces of coin storing cylinders are used and with $n+1$ pieces of driving solenoids when $2n+1$ pieces of coin storing cylinders are used. Therefore, it is not to provide such a large number of driving solenoids that is in agreement with the number of coin storing cylinders in use.

Although a change-over solenoid is required in the present invention to slidingly move a change-over lever provided therein, the change-over lever can be of a small size and capacity. Moreover, only one change-over solenoid is enough even when the number of coin storing cylinders in use is increased. This allows the selling price of the coin dispenser device to be reduced to a considerable extent.

In addition a coin dispenser device according to the present invention has a very simple construction. Namely, it consists of coin storing cylinders, slide plates the number of which is in agreement with that of the coin storing cylinders, change-over plates each of which is arranged to slidingly move a different pair of slide plates, driving solenoids the number of which is in agreement with that of the change-over plates, a change-over lever, and parts of the change-over solenoid. Therefore, it can be assembled easily at a low cost and rarely broken down. In fact, it permits an accurate coin dispensing operation.

In short, a coin dispenser device according to the present invention has a very simple construction and a small number of parts. This allows the dispenser device to be assembled easily at a low cost. In fact, the device is rarely broken down and can be operated accurately and excellently.

The present invention is not, of course, limited to the above-described embodiment; it may be modified in various ways within the scope of the appended claims.

What is claimed is:

1. A coin dispenser device comprising:

i. at least a pair of coin storing cylinders;

ii. at least a pair of slide plates disposed in opposition to said coin storing cylinders, and longitudinally movable so as to dispense coins from said coin storing cylinders;

iii. at least one change-over plate disposed in opposition to said pair of slide plates, and longitudinally and laterally movable;

iv. at least one driving solenoid arranged to longitudinally move said change-over plate;

v. means for laterally moving said change-over plate so as to selectively engage the latter with one of said slide plates, thereby said one of slide plates is longitudinally moved to dispense coins from said coin storing cylinders.

2. A coin dispenser device according to claim 1, wherein said change-over plates are laterally moved by a change-over solenoid via a change-over lever.

* * * * *